US005647434A

United States Patent [19]

Sullaway et al.

[11] Patent Number: 5,647,434

[45] Date of Patent: Jul. 15, 1997

[54] FLOATING APPARATUS FOR WELL CASING

[75] Inventors: Bobby L. Sullaway; Henry E. Rogers, both of Duncan; Dick A. Murray, Okmulgee, all of Okla.

[73] Assignee: Halliburton Company, Duncan, Okla.

[21] Appl. No.: 620,056

[22] Filed: Mar. 21, 1996

[51] Int. Cl.[6] ..... E21B 33/14; E21B 34/08

[52] U.S. Cl. ..... 166/242.8; 166/327

[58] Field of Search ..... 166/242.8, 327; 285/333, 334, 371, 398

[56] References Cited

U.S. PATENT DOCUMENTS

| | | | |
|---|---|---|---|
| 2,058,688 | 10/1936 | Halliburton | 166/318 |
| 2,117,318 | 5/1938 | Hanes | 166/325 |
| 2,204,340 | 6/1940 | Bradshaw | 166/193 |
| 2,352,744 | 7/1944 | Stoddard | 166/154 |
| 2,846,015 | 8/1958 | Pittman | 166/320 |
| 2,847,074 | 8/1958 | Maly et al. | 166/325 |
| 3,120,269 | 2/1964 | Evans et al. | 166/120 |
| 3,332,499 | 7/1967 | Harris et al. | 166/242.8 |
| 3,385,370 | 5/1968 | Knox et al. | 166/317 |
| 3,385,372 | 5/1968 | Knox | 166/325 |
| 3,409,078 | 11/1968 | Knox et al. | 166/374 |
| 3,776,250 | 12/1973 | Knox | 137/71 |
| 4,250,966 | 2/1981 | Streich et al. | 166/242.8 |
| 4,338,999 | 7/1982 | Carter, Jr. | 166/117 |
| 4,413,682 | 11/1983 | Callihan et al. | 166/242.8 |
| 4,457,377 | 7/1984 | Burris, II | 166/332.4 |
| 4,712,619 | 12/1987 | Stepp et al. | 166/327 |
| 4,729,432 | 3/1988 | Helms | 166/317 |
| 5,379,835 | 1/1995 | Streich | 166/181 |
| 5,472,053 | 12/1995 | Sullaway et al. | 166/327 |

*Primary Examiner*—David J. Bagnell
*Attorney, Agent, or Firm*—Craig W. Roddy

[57] ABSTRACT

Floating apparatus for well casing including a check valve disposed in a sleeve, wherein the sleeve is receivable within an outer case. In the case of a float collar, the outer case comprises coupled upper and lower casing string sections; while in the case of a float shoe, the outer case is individually coupled to a lower casing string section. The valve includes a valve housing, wherein a first cement body portion attaches the valve housing to the sleeve. When the embodiment of the invention is constructed as a float collar, the sleeve includes an annular flange that is outwardly extended therefrom and is received between ends of coupled upper and lower casing string sections for holding the sleeve and affixed valve within the outer case. A seal is provided between the flange and upper casing string section. Alternatively, when the embodiment of the invention is constructed as a float shoe, a second cement body portion attaches the sleeve to the outer case, thereby holding the sleeve and affixed valve within the outer case which is threadably connectable with the well casing. Preferably, the second cement body portion only partially fills an annulus between the sleeve and outer case, wherein the well casing is received in the annulus when threadably connected to the outer case.

21 Claims, 2 Drawing Sheets

FLOATING APPARATUS FOR WELL CASING

BACKGROUND

This invention relates to floating apparatus used in well cementing operations and to methods for fabricating such apparatus. More particularly, this invention relates to floating apparatus having improved means for transferring a valve load to an outer case.

Typically, after a well for the production of oil and/or gas has been drilled, casing will be lowered into and cemented in the well. The weight of the casing, particularly with deep wells, creates a tremendous amount of stress and strain on equipment used to lower the casing into the well. In order to minimize that stress, floating equipment, such as, but not limited to, float collars and/or float shoes are used in the casing string.

The float equipment typically consists of a valve affixed to the outer case which allows fluid to flow down through the casing but prevents flow in the opposite direction. Because upward flow is obstructed, a portion of the weight of the casing will float or ride on the well fluid thus reducing the amount of weight carried by the equipment lowering the casing into the well. Once the casing is in position, cement is flowed down through the inner diameter of the casing, through the valve and into the annular space between the outer diameter of the casing and the well bore. After the cement job is complete, the valve keeps the cement below and behind the casing string.

Floating apparatus is usually fabricated by affixing a check valve in an outer case which is adapted to be threaded directly into a casing string. The valve is affixed by filling the annulus between the valve housing and the outer case with a high compressive strength cement to form a cement body portion. The cement body portion transfers the valve load to the outer case such that the valve remains securely affixed within the outer case as pressure is being applied thereto. However, the present invention provides improved means for affixing the valve in the floating apparatus; thus, providing effective and more economically produced floating apparatus.

SUMMARY

The floating apparatus of the present invention is designed to provide improved means for transferring valve load to an outer case. Floating apparatus, as referred to herein, may include any device referred to in the industry as floating, such as, but not limited to, float collars and float shoes. Generally, the floating apparatus includes an outer case having an outer surface and an inner surface. The inner surface of the outer case defines a central flow passage. In the case of a float collar, the outer case comprises coupled upper and lower casing string sections; while in the case of a float shoe, the outer case is individually coupled to a lower casing string section.

A check valve is disposed in a sleeve which is receivable in the outer case. The valve includes a valve housing with an outer surface and an inner surface, wherein the inner surface may be referred to as a central opening communicated with the central flow passage.

A first body portion is fixedly attached to the valve housing and sleeve, thereby holding the valve within the sleeve. The first body portion fills the annulus between the sleeve and valve housing, and may be comprised of high compressive strength cement.

When the embodiment of the invention is constructed as a float collar, the sleeve includes an annular flange which is outwardly extended therefrom. The outer diameter of the flange is greater than the inner diameter of the outer case, whereby the flange extends between ends of the upper and lower casing string sections which are threadably received in a casing coupling.

The interposed flange is abuttingly received against the end of the lower casing string section whereby the sleeve and affixed valve are securely fixed within the outer case. In addition, a seal is received in a groove defined in the sleeve and is positioned between the flange and upper casing string section for providing a fluid-tight seal therebetween. Hence, since the casing string serves as the outer case of the float collar, the present embodiment of the invention is more economical to produce than a conventional float collar.

Alternatively, when the embodiment of the invention is constructed as a float shoe, a second body portion is fixedly attached to the sleeve and outer case, thereby holding the sleeve to and affixed valve therein. The second body portion partially fills the annulus between the sleeve and the outer case, and may be comprised of high compressive strength cement.

Furthermore, since the annulus between the sleeve and outer case is only partially filled with cement, the lower casing string section is receivable in the annulus for threadably coupling with the outer case. Hence, the outer case of the float shoe of the present invention is shorter, and thus, more economical to produce than that currently used in conventional float shoes.

The invention also includes a method for fabricating floating apparatus having improved means for transferring valve load to an outer case. The method includes providing an outer case having an inner surface and an outer surface, wherein the inner surface defines a central flow passage. The method further includes radially centrally positioning a valve in a sleeve, wherein the valve has a valve housing and an annulus is defined between an inner surface of the sleeve and the housing. The method further includes filling the annulus between the sleeve and valve housing with cement to form a first cement body portion, thereby affixing the valve housing to the sleeve. The sleeve is then positioned within the outer case.

For fabricating a float collar, the method includes the sleeve having an annular flange that is received between ends of upper and lower casing string sections for holding the sleeve and affixed valve within the casing. A seal is located between the flange and upper casing string section for providing sealing engagement therebetween.

Alternatively, for fabricating a float shoe, the method includes radially centrally positioning the sleeve in the outer case, which is threaded to receive the lower casing string section. An annulus is defined between an inner surface of the outer case and the sleeve. The annulus located between the sleeve and the outer case is partially filled with cement to form a second cement body portion, thereby affixing the sleeve to the outer case. Further, the casing is received in the annulus when the casing is threadably coupled with the outer case.

An object of the present invention is to provide improved floating apparatus for cementing casing string in a well bore.

Another object of the present invention to provide improved methods of fabricating floating apparatus for cementing casing string in a well bore.

It is a final object of the present invention to provide floating apparatus having improved means of transferring valve load between a valve and outer case.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1:
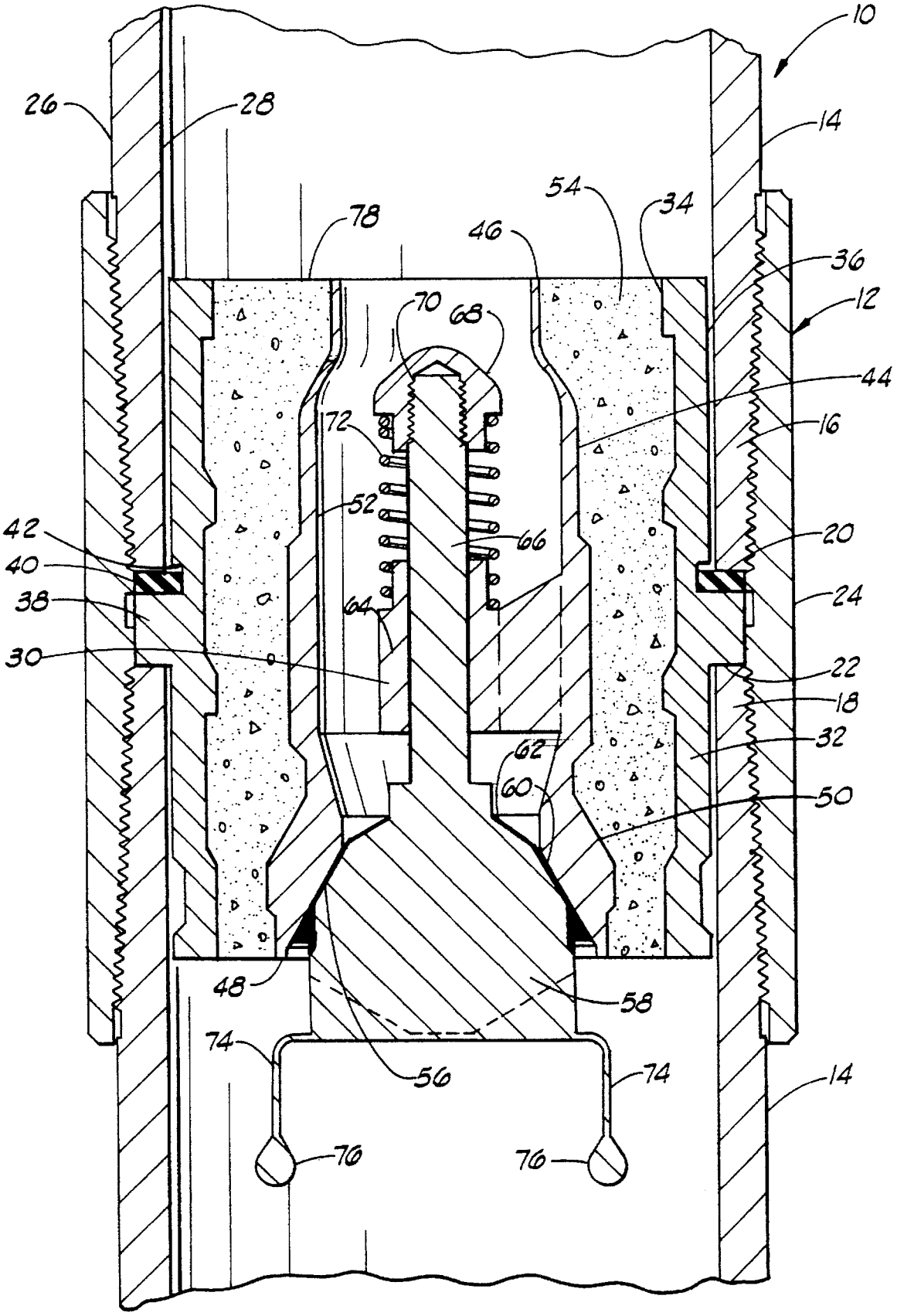
FIG. 1 is a cross-sectional view of the floating apparatus of the present invention.
Figure 2:
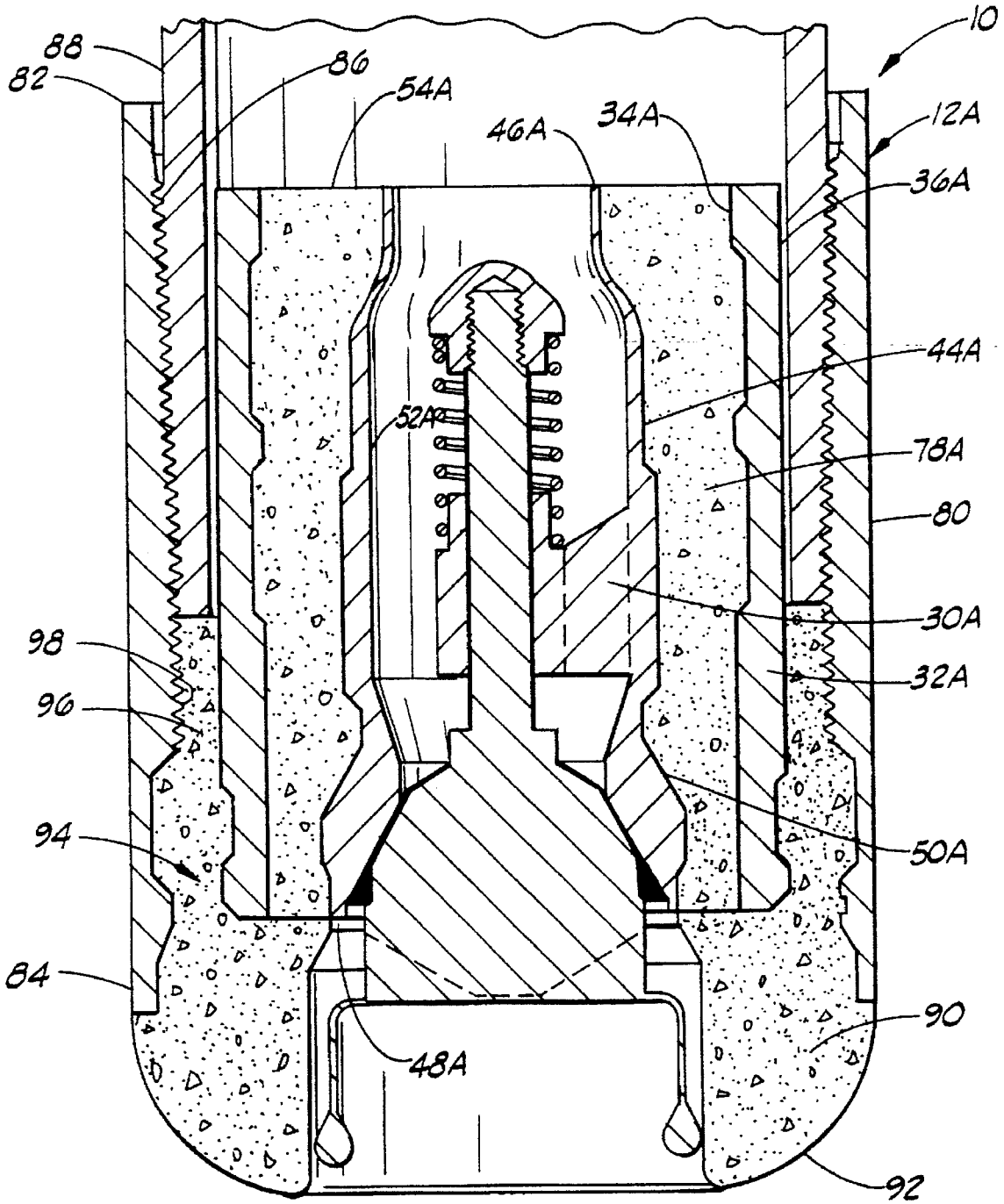
FIG. 2 is a cross-sectional view of an alternative embodiment of the floating apparatus of the present invention.

Referring now to FIGS. 1 and 2, the floating apparatus of the present invention is shown and generally designated by the numeral 10. More particularly, the embodiment shown in FIG. 1 is a float collar generally designated by the numeral 12. The float collar 12 includes a casing string which in the float collar embodiment is referred to as an outer case 14. The outer case 14 comprises upper and lower casing sections 16, 18. Each section 16, 18 having an end 20, 22, respectively, which is threadably received within a casing coupling 24. The outer case 14 having an outer surface 26 and an inner surface 28 wherein the inner surface 28 may also be referred to as a central flow passage 28.

Again referring to FIG. 1, a check valve 30 is centrally disposed in a sleeve 32, wherein the sleeve 32 is receivable within the outer case 14. The sleeve 32 has an inner surface 34 and outer surface 36. An annular flange 38 outwardly extends from the outer surface 36 of the sleeve 32. The outer diameter of the flange 38 is greater than the inner diameter of the casing string sections 16, 18, whereby the flange 38 is interposed between the ends 20, 22 when the sleeve 32 is received in the outer case 14 and when the casing string sections 16, 18 are threadably received in the casing coupling 24.

A seal 40 is received in a groove 42 defined in the sleeve 32 and is positioned between the flange 38 and end 20 of the upper casing string section 16 for providing a fluid-tight seal therebetween. The groove 42 is located adjacent to the flange 38. Thus, the sleeve 32 and valve 30 are sealingly affixed within the outer case 14. Preferably, the sleeve 32 is constructed of a drillable material such as aluminum or non-metallic materials including engineering grade plastics, resins, composites, or other suitably known materials.

More particularly, the valve 30 includes a valve housing 44 having an upper end 46, a lower end 48, an outer surface 50 and an inner surface 52. The inner surface 52 may also be referred to as a central opening 52. An annulus 54 is defined between the valve housing 44 and inner surface 34 of the sleeve 32.

A valve seat 56 is defined on the inner surface 52 of the housing 44. The check valve 30 further includes a valve element 58 having a sealing surface 60 which sealingly engages the valve seat 56. A lip seal 62 may be defined on the sealing surface 60. A valve guide 64 disposed in the valve housing 44 slidingly receives a valve stem 66 which extends upwardly from the valve element 58. A valve cap 68 is attached to an upper end 70 of the valve stem 66. A valve spring 72 is disposed about the valve stem 66 between the valve cap 68 and the valve guide 64. The valve spring 72 biases the valve cap 68 upwardly thereby sealingly engaging the valve seat 56 and sealing surface 60 of the valve element 58.

The valve 30 may further include an auto-fill strap 74 attached to the valve element 58. The auto-fill strap 74 has a rounded end or bead 76 disposed at each end. The beads 76 may be placed between the valve seat 56 and sealing surface 60 prior to lowering the casing string into a well, thereby allowing fluid to flow through the casing and through the apparatus 10 as it is lowered into the well.

Once the casing is in place, fluid is pumped into the apparatus 10 forcing the valve element 58 down and releasing the beads 76. Once fluid flow is stopped, the spring 72 will urge the valve stem 66 upwardly, so that the valve element 58 sealingly engages the sealing surface 60. Thus, the auto-fill strap 74 may be referred to as a means for releasably disengaging the valve element 58 from the valve seat 56.

The apparatus 10 further includes a first body portion 78 disposed in the annulus 54 defined between the valve housing 44 and inner surface 34 of the sleeve 32. The body portion 78 is typically comprised of a high compressive strength cement which fixedly attaches the valve housing 44 to the inner surface 34 of the sleeve 32.

After the valve 30 and affixed sleeve 32 are coupled within the outer case 14, the casing string including the present invention is lowered into a well. Once the casing string is in place, cement is flowed down and out the lower end of the casing string. The cement fills an annulus between the outer surface of the casing string and the well bore, thus cementing the casing in place.

An alternative embodiment of the invention is shown in FIG. 2. The embodiment shown in FIG. 2 includes features that are similar to those shown in FIG. 1, but that have been modified, and are generally designated by the suffix A. The remaining features are substantially identical to the features of the embodiment shown in FIG. 1. The embodiment shown in FIG. 2 is a float shoe generally designated by the numeral 12A. Float shoe 12A has an outer case 80 with an upper end 82 and a lower end 84. The upper end 82 is threaded 86 so that it may be threadably connected to a casing string 88 thereabove. However, the lower end 84 does not include a thread. The float shoe 12A includes an end portion 90 which extends below the lower end 84 of the outer case 80 and forms a guide surface 92.

The embodiment shown in FIG. 2 likewise includes a check valve 30A disposed in a sleeve 32A, wherein the sleeve 32A is disposed in the outer case 80 and an annulus 94 is defined therebetween. The casing string 88 is receivable between the outer case 80 and sleeve 32A for threadably connecting with the outer case 80.

The valve 30A includes a valve housing 44A having an upper end 46A, a lower end 48A, an outer surface 50A and an inner surface 52A. The inner surface 52A may also be referred to as a central opening 52A. An annulus 54A is defined between the valve housing 44A and an inner surface 34A of the sleeve 32A. The float shoe 12A further includes a first body portion 78A disposed in the annulus 54A between the valve housing 44A and inner surface 34A of the sleeve 32A. The body portion 78A is typically comprised of a high compressive strength cement which fixedly attaches the valve housing 44A to the inner surface 34A of the sleeve 32A.

In addition, the float shoe 12A includes a second body portion 96 disposed in the annulus 94 defined between the valve housing 44A and outer case 80. The second body portion 96 is typically comprised of a high compressive strength cement which fixedly attaches an outer surface 36A of the sleeve 32A to an inner surface 98 of the outer case 80. Wherefore, once the cementing job is complete, the valve 30A should operate to keep cement from re-entering the casing 88.

The preferred second body portion 96 only partially fills the annulus 94 between the sleeve 32A and outer case 80. Further, since the annulus 94 between the sleeve 32A and outer case 80 is only partially filled with cement, the casing string 88 is receivable between the sleeve 32A and outer case 80 for threadably coupling with the outer case 80.

The invention also includes a method for fabricating floating apparatus, such as the float collar and float shoe, having improved means of transferring valve load to the outer case thereof. The method includes radially centrally positioning a valve, which has a valve housing, in a sleeve such that an annulus is defined between an outer surface of the valve housing and an inner surface of the sleeve. The sleeve is then positioned within the outer case.

The method further includes filling the annulus between the sleeve and valve housing with cement to form a first cement body portion, thereby affixing the outer surface of the valve housing to the inner surface of the sleeve. When fabricating the float collar, the sleeve includes a flange that is received between the ends of casing string sections to hold the sleeve and affixed valve therein. Additionally, a seal is received in a groove defined in the sleeve and is positioned between the flange and an end of an upper casing string section.

Alternatively, when fabricating the float shoe, the sleeve is radially centrally positioned in the outer case, wherein an annulus is defined between an inner surface of the outer case and the sleeve. The annulus defined between the sleeve and outer case is filled with cement to form a second cement body portion, thereby affixing the sleeve to the outer case.

The apparatus and methods of the present invention provide float apparatus 10 which are effective and more economical to produce than conventional float equipment. Further, it will be seen that the floating apparatus 10 of the present invention and methods of fabricating such apparatus are well adapted to carry out the ends and advantages mentioned as well as those inherent therein.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A floating apparatus for use in a well casing having upper and lower casing string sections coupled with a casing coupling, the apparatus comprising:

a sleeve which is receivable within the well casing;

a flange for holding said sleeve in the well casing, said flange extends outwardly from said sleeve such that said flange is interposed between the casing string sections when the sections are coupled;

a valve disposed in said sleeve; and means for attaching said valve to said sleeve.

2. The apparatus of claim 1 wherein said valve includes a check valve comprising:

a valve housing having a central opening;

a valve seat defined on said valve housing;

a valve guide disposed in the central opening of said valve housing;

a valve element having a sealing surface sealingly engageable with said valve seat; and a valve stem extending upwardly from said valve element and slidably received through said valve guide.

3. The apparatus of claim 2 further comprising means for releasably disengaging said valve element from said valve seat, so that fluid can pass through the central opening as the casing is lowered into a well and so that said valve element and said valve seat can be sealingly engaged after the casing has been lowered into the well.

4. The apparatus of claim 1 wherein the sleeve is comprised of a drillable material.

5. The apparatus of claim 1 wherein the flange is annularly extended from said sleeve.

6. The apparatus of claim 1 further comprising a seal positioned between said flange and the upper casing string section.

7. The apparatus of claim 6 wherein said seal is received in a groove defined in said sleeve.

8. A floating apparatus for well casing, comprising:

an outer case adapted to be connected to the well casing;

a sleeve disposed within said outer case;

a valve disposed within said sleeve;

means for attaching said valve to said sleeve;

means for attaching said sleeve to said outer case; and wherein the well casing is receivable between said outer case and said sleeve for threadably connecting with the apparatus.

9. The apparatus of claim 8 wherein said means for attaching said sleeve to said outer case partially fills an annulus defined between said sleeve and said outer case.

10. The apparatus of claim 8 wherein said means for attaching said valve to said sleeve comprises cement.

11. The apparatus of claim 8 wherein said means for attaching said sleeve to said outer case comprises cement.

12. The apparatus of claim 8 wherein said valve is a check valve comprising:

a valve housing having a central opening;

a valve seat defined on said valve housing;

a valve guide disposed in the central opening of said valve housing;

a valve element having a sealing surface sealingly engageable with said valve seat; and a valve stem extending upwardly from said valve element and slidably received through said valve guide.

13. The apparatus of claim 12 further comprising means for releasably disengaging said valve element from said valve seat, so that fluid can pass through the central opening as the casing is lowered into a well and so that said valve element and said valve seat can be sealingly engaged after the casing has been lowered into the well.

14. The apparatus of claim 8 wherein said sleeve is comprised of a drillable material.

15. A floating apparatus for well casing, comprising:

an outer case adapted to be connected to the well casing;

a sleeve disposed within said outer case;

a valve disposed within said sleeve;

means for attaching said valve to said sleeve;

means for attaching said sleeve to said outer case; and wherein said means for attaching said sleeve to said outer case comprises cement.

16. The apparatus of claim 15 wherein said means for attaching said sleeve to said outer case partially fills an annulus defined between said sleeve and said outer case.

17. The apparatus of claim 15 wherein said means for attaching said valve to said sleeve comprises cement.

18. The apparatus of claim 17 wherein the well casing is receivable between said outer case and said sleeve for threadably connecting with the apparatus.

19. The apparatus of claim 15 wherein said valve is a check valve comprising:

a valve housing having a central opening;

a valve seat defined on said valve housing;

a valve guide disposed in the central opening of said valve housing;

a valve element having a sealing surface sealingly engageable with said valve seat; and a valve stem extending upwardly from said valve element and slidably received through said valve guide.

20. The apparatus of claim 19 further comprising means for releasably disengaging said valve element from said valve seat, so that fluid can pass through the central opening as the casing is lowered into a well and so that said valve element and said valve seat can be sealingly engaged after the casing has been lowered into the well.

21. The apparatus of claim 15 wherein said sleeve is comprised of a drillable material.

* * * * *